United States Patent [19]

Sumnall

[11] Patent Number: 4,944,090

[45] Date of Patent: Jul. 31, 1990

[54] RAZOR HEAD WITH YIELDABLE SHAVING AID

[76] Inventor: Stanley Sumnall, 2551 N. 17th, Springfield, Oreg. 97477

[21] Appl. No.: 331,832

[22] Filed: Apr. 3, 1989

[51] Int. Cl.[5] ..... B26B 19/44; B26B 21/00; B26B 21/40

[52] U.S. Cl. ..... 30/41; 30/50; 30/90

[58] Field of Search ..... 30/34, 41, 41.5, 50, 30/87, 90

[56] References Cited

U.S. PATENT DOCUMENTS

| | | | |
|---|---|---|---|
| 3,895,437 | 7/1975 | DiBuono | 30/90 |
| 3,969,817 | 7/1976 | DiBuono | 30/41 |
| 4,170,821 | 10/1979 | Booth | 30/41 |
| 4,586,255 | 5/1986 | Jacobson | 30/41 |
| 4,587,729 | 5/1986 | Jacobson | 30/41 |
| 4,621,424 | 11/1986 | Jacobson | 30/41 |
| 4,624,051 | 11/1986 | Apprill, Jr. et al. | 30/50 |
| 4,683,096 | 7/1987 | Ferraro | 30/41 |
| 4,697,342 | 10/1987 | Ferraro | 30/41 |
| 4,754,548 | 7/1988 | Solow | 30/50 |

*Primary Examiner*—Douglas D. Watts
*Assistant Examiner*—Paul M. Heyrana, Sr.
*Attorney, Agent, or Firm*—James D. Givnan, Jr.

[57] ABSTRACT

Razor construction including a soluble body carried by a razor head or cartridge in a yieldable manner by a leaf spring. The soluble body is urged into skin contact to deposit a shaving aid thereon. The razor head defines a chamber in which the soluble body is housed with the leaf spring urging the body through an opening in the razor head. Various spring shapes are disclosed. A fixedly mounted body of a shaving aid may also be carried by the razor head or cartridge.

9 Claims, 1 Drawing Sheet

RAZOR HEAD WITH YIELDABLE SHAVING AID

BACKGROUND OF THE INVENTION

The present invention pertains generally to disposable razors of the type having a water soluble body thereon as an aid to shaving.

Razors currently marketed are provided with one or more blades movably or fixedly mounted on the razor head. In the recent past, razors have been made available which include a body of material for skin contact which provides a lubricant, whisker softener, etc., to the skin during shaving. Such improvements are found in U. S. Pat. Nos. 4,170,821; 3,895,437; 3,969,817 and 4697,342 to mention a few.

A problem encountered with known razor designs is that the quantity of material, a lubricant for example, is severely restricted by being fixedly mounted in place on the razor head. U.S. Pat. No. 3,895,437(noted above) provides a manually pre-positioned body of a beard softener mounted in a detachable manner by arm linkages to a razor handle. It should be noted as the quantity of softener material lessens with each shave, the blade angle varies which, of course, is undesirable as is the necessary manipulation of supporting linkages. Further the razor envelope is sizably increased rendering the razor less compact hindering both razor storage and transport.

SUMMARY OF THE PRESENT INVENTION

The present invention is embodied in a razor which provides a sizable quantity of a shaving aid in a yieldable manner.

The present razor head retains the desirable features of uniform blade presentation to the skin while providing a quantity of aid material sufficient to last the duration of razor life. The razor head defines a chamber which receives a soluble body of material with resilient mounting means urging the body of material outwardly through a razor head opening and into contact with the skin. A suitable mounting means is in the nature of flat spring means having a distal end attached to the soluble body. The razor head may additionally mount a second body of like or other soluble material for the same or other purposes.

Important objectives include the provision of a razor head having a relatively large quantity of soluble material for deposit on the skin without significantly altering desirable razor features such as head size and configuration; the provision of a razor head which utilizes space existing in existing razor head designs to receive a quantity of soluble material.

DETAILED DESCRIPTION OF THE PREFERRED EMBODIMENTS

Figure 1:
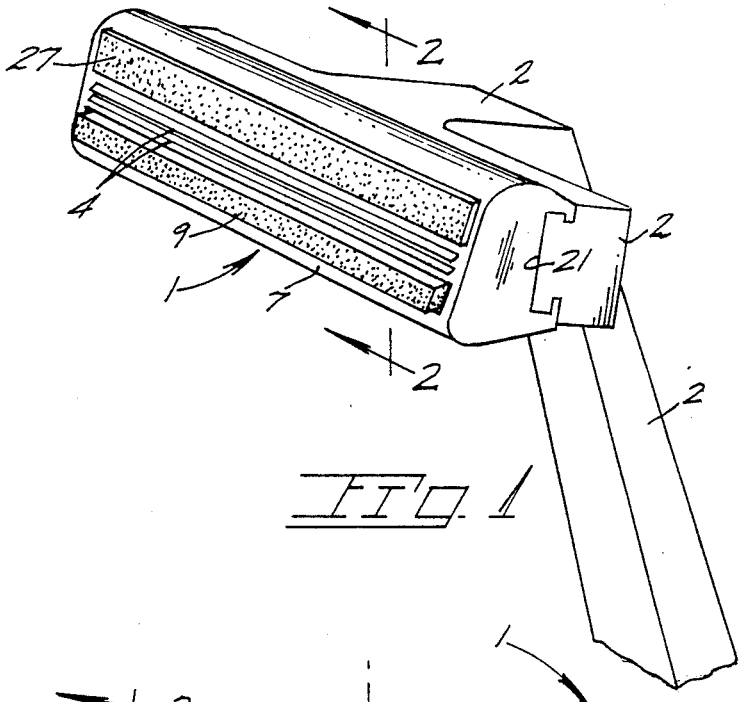
FIG. 1 is a perspective view of the present razor head in one embodiment.

With continuing attention to the drawings wherein applied reference numerals indicate parts similarly hereinafter identified, the reference numeral 1 indicates generally a razor head which may be of the cartridge type or integral with a razor handle portion at 2.

Figure 2:
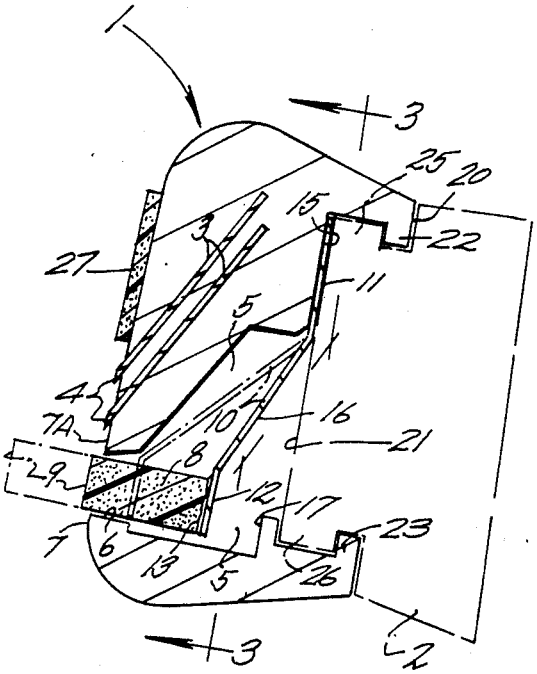
FIG. 2 is a vertical sectional view taken along line 2—2 of FIG. 1.
Figure 3:
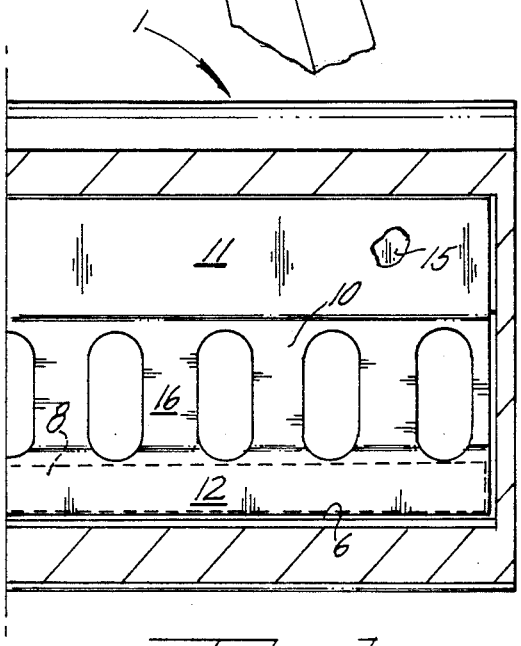
FIG. 3 is a vertical sectional view taken along line 3—3 of FIG. 2.

The head is elongate and receives preferably multiple blades at 3 having cutting edges at 4. The head defines a chamber at 5 (FIG. 2) which is in communication via an opening 6, with the front or skin engaging head surface 7. A head surface at 7A is intermediate a blade 3 and opening 6.

Figure 4:
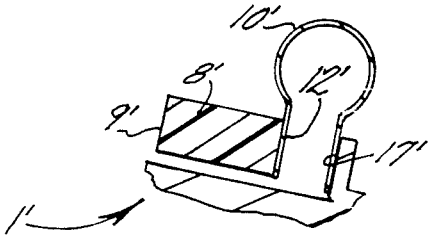
FIG. 4 is sectional view taken a modified leaf spring.

A body 8 of soluble material is housed in razor head 1 in a yieldable manner so as to present a forwardly disposed surface 9 to the skin. Flexible mounting means at 10 has a marginal portion at 11 carried by a razor head wall surface as at 15. A distal portion at 12 is suitably attached to body 8 as by a non-soluble adhesive 13. Flexible mounting means 10 is shown as a flat spring adapted to lightly bias body 8 in an outwardly direction through opening 6. The spring is of cross section shape having a mid-portion at 16 to permit reciprocal movement of body 8 through opening 6 under the influence of flexible means 10 and, oppositely, skin contact. It is to be understood that spring shape may be otherwise, as for example, a spring of inverted U-shape in vertical transverse section per FIG. 4 with a spring margin attached to a head wall surface at 17'. While the term spring is used above such comprehends multiple springs and springs having relieved areas to provide desired flexing.

If the razor head is unitary or a "cartridge" as shown, then the head will terminate rearwardly in a wall 20 segmented to admit a handle end 21 suitably configured for cartridge engagement. For example, the head or cartridge may have lengthwise extending ribs at 22 and 23 which partially define recessed areas into which shoulders 25 and 26 on the handle may be lengthwise inserted.

With regard to the composition of soluble body 8, the same may be as set forth in U.S. Pat. Nos. 4,170,821 and 4,697,342 to provide a deposit on the skin as it is drawn thereover. One desirable objective of such body is as a lubricant for the skin to lessen abrasion by the blade edges. Other objectives may be served by body 8 containing an antiseptic agent. If so desired, a second or fixedly mounted, soluble body at 27 may be provided to provide an additional source of a shaving aid. Such fixedly mounted soluble body is disposed on housing frontal surface 7 above the blade edges 4.

Figure 5:
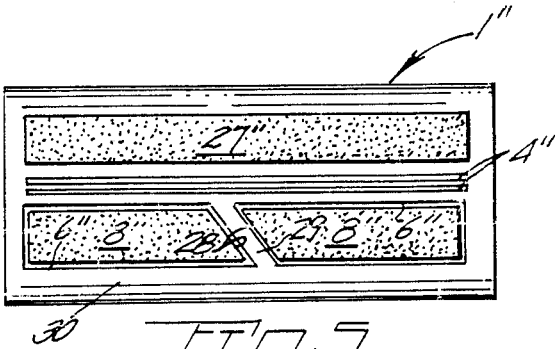

In FIG. 5, (a front elevational view of modified razor construction) the soluble body 8'' is bifurcated at 28 to permit a support 29 across opening 6'' which prevents flexing of the lower or leading edge 30 of razor 1''. The canted inner edges 28 of body 8'' provide a continuous wiped area for uniform deposit on the skin. Components are identified with prime reference numerals and correspond to structure identified earlier with base reference numerals.

In use, the present razor construction is intended to permit shaving without a shaving lubricant such as a foam or gel being applied to the skin. The body 8 is of adequate size to last the life of the razor, typically through several shavings.

While I have shown but a few embodiments of the invention, it will be apparent to those skilled in the art that the invention may be embodied still otherwise without departing form the spirit and scope of the invention.

Having thus described the invention, what is desired to be secured by a Letters Patent is:

1. An elongate razor head including, a blade, a soluble body movable relative said head, said head defining a chamber to receive said soluble body and an opening through which said body may protrude for skin contact, and spring means attaching said body to said head, said spring means having a distal portion, said soluble body attached to said distal portion by adhesive means said spring means urging said body outwardly of said opening for biased contact with the user's skin.

2. The razor head in claim 1 wherein said head includes means for attachment to the handle of a razor.

3. The razor head claimed in claim 1 wherein said soluble body is substantially coextensive in length with said blade.

4. The razor claimed in claim 1 wherein said spring means includes a flat spring normally biasing said body so as to protrude through said opening.

5. The razor head claimed in claim 1 wherein said head includes a fixedly mounted soluble body.

6. The razor head claimed in claim 5 wherein said fixedly mounted soluble body and said soluble body are oppositely offset from said blade.

7. The razor head claimed in claim 1 wherein said soluble body is segmented.

8. The razor head in claim 1 wherein said spring means is of U-shaped in transverse section.

9. The razor head claimed in claim 1 wherein said spring means defines relieved areas.

* * * * *